United States Patent [19]

Evans

[11] 4,159,219

[45] * Jun. 26, 1979

[54] METHOD FOR PRODUCING AN UNBACKED TENSION FLOOR

[75] Inventor: Richard J. Evans, Lancaster, Pa.

[73] Assignee: Armstrong Cork Company, Lancaster, Pa.

[ * ] Notice: The portion of the term of this patent subsequent to Nov. 9, 1993, has been disclaimed.

[21] Appl. No.: 859,741

[22] Filed: Dec. 12, 1977

Related U.S. Application Data

[63] Continuation of Ser. No. 606,449, Aug. 21, 1975, abandoned, which is a continuation of Ser. No. 524,562, Nov. 18, 1974, abandoned.

[51] Int. Cl.[2] ..... B32B 31/12; E04F 15/00

[52] U.S. Cl. ..... 156/71; 156/160; 156/184; 156/229; 156/249; 156/289; 156/290; 428/159

[58] Field of Search ..... 156/71, 160, 184, 229, 156/249, 289, 290; 428/159

[56] References Cited

U.S. PATENT DOCUMENTS

| | | | |
|---|---|---|---|
| 2,876,893 | 3/1959 | Blackford et al. | 206/412 |
| 2,920,977 | 1/1960 | Adams | 428/170 X |
| 3,464,178 | 9/1969 | Deichert et al. | 156/71 X |
| 3,658,617 | 4/1972 | Fearnow et al. | 156/249 X |
| 3,990,929 | 11/1976 | Evans | 156/71 |

*Primary Examiner*—John T. Goolkasian
*Assistant Examiner*—Robert A. Dawson

[57] ABSTRACT

An unbacked decorative thermoplastic vinyl resin containing surface covering having a self-induced tension is manufactured by (1) fusing a vinyl resin composition decorative layer and a vinyl resin composition backing layer to a strippable dimensionally stable backing to form a fused thermoplastic decorative surface covering, and (2) removing the strippable backing and rolling the surface covering, thus placing the surface covering under tension and thereby elongating the outward facing layer and compressing the other layer. The composition and structure of the outward facing layer is such that, on unrolling the surface covering, the elongated layer overcomes the compressed layer and the surface covering is stretched to a dimension greater than its original unrolled dimension. On securing the surface covering at its periphery only, the tendency of the surface covering to return to its original dimension, i.e. its elastic memory, creates a self-induced tension therein.

4 Claims, No Drawings

METHOD FOR PRODUCING AN UNBACKED TENSION FLOOR

CROSS-REFERENCE TO RELATED APPLICATION

This is a continuation of application Ser. No. 606,449, filed Aug. 21, 1975, now abandoned, which is a continuation of application Ser. No. 524,562, filed Nov. 18, 1974, now abandoned.

BACKGROUND OF THE INVENTION

1. Field of the Invention

The field of the invention relates to decorative thermoplastic vinyl resin-containing sheet surface coverings or flooring which may be installed such that they have a tension built in on installation.

2. Description of the Prior Art

It has been recognized in the prior art that stresses sometimes built into commercial thermoplastic vinyl resin-containing decorative sheet floor coverings may sometimes be taken advantage of in that the tension caused by the stresses may be used, utilizing certain installation techniques, to create an installed floor product having a self-induced tension built in therein. Examples of such installations are disclosed in Deichert et al, U.S. Pat. No. 3,464,178 and Evans U.S. Application Ser. No. 153,872 filed June 16, 1971. It is also known from Hassel U.S. Pat. No. 2,913,773 to consolidate a homogeneous vinyl resin composition decorative layer to a strippable backing after which the backing is removed and from Adams U.S. Pat. No. 2,920,977 to apply a film to a strippable backing after which a cellular vinyl layer is applied to the film. Neither Hassel nor Adams suggests that a self-induced tension floor installation could be achieved with their products.

SUMMARY OF THE INVENTION

In accordance with my invention, I have provided an unbacked decorative thermoplastic vinyl resin-containing sheet surface covering having at least two distinct thermoplastic layers wherein the compositions and thicknesses of such layers are such that, on rolling the sheet, the layer facing outward in the roll is stretched to a degree greater than the degree to which the other layer is compressed. On unrolling the sheet, the sheet is placed under tension by the stresses set up therein by the opposing stretching and compressive forces, these forces stretching the surface covering to a dimension greater than its original dimension. When the sheet is installed before tension has been relieved, a self-induced tension is built into the installed sheet and this acts to maintain the sheet flat even on a wood substrate that is subjected to a fluctuating environment.

DESCRIPTION OF THE PREFERRED EMBODIMENTS

In a copending application, Ser. No. 153,872, filed June 16, 1971 and now abandoned, I have described a method of installing a resilient decorative thermoplastic surface covering wherein a vinyl resin-containing composition is fused under heat and pressure to a thermally dimensionally stable strippable backing layer with the backing layer maintaining the fused thermoplastic wear layer under tension until ready for installation. At the installation site, the backing is stripped and the wear layer secured against movement with respect to the surface being covered only at its periphery. The installation is completed before stresses in the wear layer are relieved and a self-induced tension is built into the wear layer keeping it flat even on a wood substrate that is subjected to a fluctuating environment.

I have now discovered that an all thermoplastic sheet consisting of two or more thermoplastic layers may be constructed such that, when rolled for transporting, and unrolled for installation, it also will have a self-induced tension built therein when installed by securing it at its periphery against movement with respect to the surface being covered. This results in an obvious advantage over the invention described in my copending application in that no backing has to be stripped from the thermoplastic sheet at the installation site prior to cutting the sheet to size and installing the sheet.

As described herein, the thermoplastic decorative or wear layer means the decorative wear layer, per se and any protective clear coat which may be applied thereto.

In accordance with my invention, a carrier such as paper or felt carrying a release coating thereon is coated with a vinyl resin-containing coating which may be compounded to the degree required to give it the desired compression or elongation characteristics after which a separate and distinct decorative vinyl resin-containing layer is applied thereover and the whole consolidated and fused to form two distinct thermoplastic vinyl resin-containing layers. As the resins used, I prefer to use plasticized poly(vinyl chloride), either the homopolymers or copolymers customarily used in the manufacture of decorative thermoplastic coverings of the type currently commercially available, and I have found that I may form these layers with conventional plastisols and/or conventional dry blending resin formulations. The only critical factor of which I am aware are the adjustments that must be made as to the thicknesses of the two distinct layers and adjustments between resins, fillers, plasticizers, etc. used in formulating so as to achieve the desired results when the sheet is rolled, whereby the outward facing layer is stretched and the other layer compressed when the sheet is in a rolled form. The several parameters must be adjusted such that, when the sheet is rolled, the outward facing layer is stretched to a degree which is greater than the degree to which the other layer is compressed. That is, when the sheet or surface covering is unrolled, the elongated layer must overcome the compressed layer such that the surface covering is initially stretched to a dimension greater than its original unrolled dimension. The respective layers may be so designed that the sheet may be rolled with the decorative layer facing outward or inward in the roll depending on the elongation and compression characteristics of said layers.

After the thermoplastic sheet surface covering has been formed in accordance with this invention, it is stripped from the strippable carrier and rolled so that stresses are built into the sheet by the above-described stretching and compressing forces acting on the layers while the sheet is in rolled form.

As is the usual custom, the sheet is shipped to the installation site where it is unrolled, cut to size and installed. When the sheet is installed, and before the stresses therein are relieved, by securing the sheet along the periphery thereof and over the surface to be covered, the stresses set up in the sheet create a built-in self-induced tension such that the sheet is unaffected even on a wood substrate that is subjected to a fluctuating environment and remains flat on the surface over which it is installed.

The following examples illustrate specific embodiments of the invention. In the examples, PVC means poly(vinyl chloride) and MN means average molecular weight.

EXAMPLE 1

A carrier is coated with a release coating and dried. This release coating is applied to the carrier using a forward roll coater and then air dried.

| Release Coat | |
|---|---|
| Ingredient | Parts by Weight |
| Methocel, 15 cps. (Methyl Cellulose) | 525 |
| Water | 5272 |
| Crushed Ice | 800 |
| Polyglycol P-1200 (Polypropylene Glycol MW-1200) | 7.4 |
| White Pigment ($T_1O_2$) | 65.0 |
| Green Pigment (Iron Nitroso Beta Naphthol Pulp) | 35.0 |

Seven mils of a filled plastisol base coat are applied to the release coated carrier using a reverse roll coater. This coating is then gelled in an oven to 290° F.

| Base Coat | |
|---|---|
| Ingredient | Parts by Weight |
| Tenneco 1732 (Dispersion PVC Homopolymer Resin MW-106,000) | 625.0 |
| Diamond PVC-71 (PVC Homopolymer Resin MW-139,000 | 625.0 |
| Tenneco 501 (Blending Resin MW-95,300, Poly (vinyl chloride - vinyl acetate) Copolymer Resin - 95.5% vinyl chloride, 4.5% vinyl acetate) | 1250.0 |
| DOP (Di-2-Ethylhexyl phthalate) | 400.0 |
| White Paste (50/50 DOP/$T_1O_2$) | 249.0 |
| Black Pigment (Carbon black) | 1.0 |
| Drapex 4.4 (Cetyl Epoxy Tallate) | 125.0 |
| TXIB (2-2-4 Trimethyl-1,3 Pentanediol Monoisobutyrate ester) | 250.0 |
| V-1366 (Ba. Ca. Zn. Phosphite) | 125.0 |
| Peg 200 (Polyethylene Glycol Monolaurate) | 50.0 |
| Camel Carb. (Calcium Carbonate) | 1000.0 |
| SMS (Mineral Spirits) | 62.5 |

Twenty-one mils of plastisol foam are applied on top of the base coat using a reverse roll coater and this is gelled in an oven to 270° F.

| Foam | |
|---|---|
| Ingredient | Parts by Weight |
| Exon 605 (Dispersion PVC Homopolymer Resin MW 80,400) | 1200 |
| Stauffer SCC-20 (Dispersion PVC Homopolymer Resin MW 114,000) | 500 |
| Geon 120 × 251 (PVC Homopolymer Resin) | 320 |
| Goodyear M-70 (Blending PVC Homopolymer Resin MW-81,100) | 700 |
| Drapex 4.4 (Octyl Epoxy Tallate) | 30 |
| DOP (Di-2-Ethylhexyl phthalate) | 1546 |
| T-3603 (Ba. Zn. Neodecanoate) | 284 |
| LU-390 (Aluminum Silicate) | 350 |

The gelled foam is then printed with standard inks in the desired design on a Rotogravure Press. A standard ink formulation is as follows:

| Ingredient | Percent by Weight |
|---|---|
| Plastoprint Extender (5-Q-211) | 5.24 |
| Plastoprint Clay Extender (10-Q-948) | 5.24 |
| Plastoprint Solvent | 17.48 |
| Triton X-100 (Alkylated Acryl Polyether Alcohol) | 0.87 |
| Plastoprint Brown (80-Q-860) | 31.47 |
| Plastoprint Medium Chrome Yellow (20-Q-210) | 15.73 |
| Plastoprint Molybdate Orange (30-Q-149) | 19.23 |
| Polyethylene Wax Dispersion | 4.74 |

In the above formulation, the Plastoprint Solvent is a mixture of 77 percent by weight 2-nitropropane, 13 percent by weight diacetone alcohol and 10 percent by weight isopropyl acetate. The Plastoprint Extender is a solution of a poly(vinyl chloride-vinyl acetate) copolymer (between about 3 and 8 percent vinyl acetate) in Plastoprint Solvent and the Plastoprint Clay Extender is Plastoprint Extender containing about 30 percent by weight clay. All of the pigments are mixed with Plastoprint Extender; the Plastoprint Brown containing about 21 percent by weight molybdate orange and 4 percent by weight molybdate black; the Plastoprint Medium Chrome Yellow containing about 29.8 percent by weight medium chrome yellow; and the Plastoprint Molybdate Orange containing about 30 percent by weight molybdate orange.

Fourteen mils of a clear plastisol are applied using a reverse roll coater and then the decorative surface covering heated to 385° F. causing the blowing agent to decompose to foam the foam layer and to fuse the clear coat.

| Clear Coat | |
|---|---|
| Ingredient | Parts by Weight |
| Tenneco 1742 (Dispersion PVC Homopolymer Resin MW-120,000) | 1920.0 |
| Tenneco 521 (Poly(vinyl chloride - vinyl acetate) Copolymer Extender Resin MW-75,900, 95.5% vinyl chloride, 4.5% vinyl acetate | 1280.0 |
| Drapex 4.4 (Octyl Epoxy Tallate) | 160.0 |
| DOP (Di-2-Ethylhexyl phthalate) | 384.0 |
| TXIB (2-2-4 Trimethyl-1,3 Pentanediol Monoisobutyrate ester) | 160.0 |
| Nuostabe V-1060 (Ba, Cd, Zn Compound) | 96.0 |
| Nuopaz 1046 (2-2-4 Trimethyl-1,3 Pentanediol Monoisobutyrate ester) | 864.0 |

The release carrier is stripped from the product, and is utilized as a slip sheet with the product being wound on a seven inch core in roll form.

EXAMPLE 2

A carrier is coated with a release coating and dried in the same manner as set forth in Example 1.

A reverse roll coater is used to apply seven mils of a plastisol base coat to the release carrier. This coating is then gelled in an oven to 290° F.

| Base Coat | |
|---|---|
| Ingredient | Parts by Weight |
| Exon 6337 (PVC Homopolymer Dispersion Resin Mw-141,000) | 400 |
| Blacar 1738 (PVC Homopolymer Dispersion Resin MW-233,000) | 1250 |

-continued

| Base Coat | |
|---|---|
| Ingredient | Parts by Weight |
| Blacar 501 (PVC Homopolymer Blending Resin MW-95,300) | 1100 |
| DOP (di-2-Ethylhexyl phthalate) | 383 |
| TXIB (2-2-4 Trimethyl-1,3 Pentanediol Monoisobutyrate ester) | 383 |
| S-160 (Butyl-Benzyl Phthalate) | 205 |
| V-1366 (1% Ba., .8% Ca., .9% Zn, 5.4% P) | 77 |
| Pigment as required | |

The base coat is then coated with a very thin layer of a clear plastisol that is applied with a rotary screen printer.

| Clear Plastisol | |
|---|---|
| Ingredient | Parts by Weight |
| Blacar 1732 (PVC Homopolymer Dispersion Resin) | 100 |
| DOP (di-2-ethylhexyl phthalate) | 32 |
| TXIB (2-2-4 Trimethyl-1,3 Pentanediol Monoisobutyrate ester) | 17 |
| M-275 (Organotin Stabilizer) | 2 |

A dry blend 28 mils thick is metered onto the wet plastisol coat and the dry blend is then sintered at 350° F.

| Dry Blend | |
|---|---|
| Ingredient | Parts by Weight |
| Exon 9290 (PVC Homopolymer MW-83,900) | 250 |
| M-275 (Organotin Stabilizer) | 5 |
| DOP (Di-2-ethylhexyl phthalate) | 75 |
| Hi Sil 233 (Amorphous Hydrated Silicate) | 0.63 |

Foamable plastisol inks are printed into the sintered dry blend in the desired design and those areas not printed are then printed with non-foamable plastisol inks using a Zimmer Printer. The inks are then gelled at 270° F.

The foamable ink contains 20.72 parts by weight paste and 400.00 parts by weight paste foamable ink.

| Foamable Ink | |
|---|---|
| Ingredient | Parts by Weight |
| Exon 605 (PVC Homopolymer Dispersion Resin MW-80,400) | 2000 |
| DOP (Di-2-ethylhexyl phthalate) | 900 |
| Drapex 4.4 (Octyl Epoxy Tallate) | 40 |
| ABC-18 (Organic Zinc Complex) | 60 |
| | 3000 |

| Paste | |
|---|---|
| Ingredient | Parts by Weight |
| Kempore AF (Azodicarbonamide) | 90.1 |
| DOP (Di-2-ethylhexyl phthalate) | 128.7 |
| | 218.8 |

| Non-Foamable Ink | |
|---|---|
| Ingredient | Parts by Weight |
| Blacar 1732 (PVC Homopolymer Dispersion Resin MW-106,000) | 2100 |
| DOP (Di-2-ethylhexyl phthalate) | 252 |
| S-711 ($C_7$-$C_9$-$C_{11}$ Mixture, Phthalates) | 630 |
| Synpron 744 (Ba. Zn. Phosphite Stabilizer) | 42 |
| | 3024 |

The structure is then coated with a clear plastisol using a reverse roll coater and heated to 385° F. to fuse the resins and expand the pattern in the areas printed with the foamable inks.

| Clear Plastisol | |
|---|---|
| Ingredient | Parts by Weight |
| Exon 6337 (PVC Homopolymer Dispersion Resin MW-141,000) | 550 |
| Blacar 1738 (PVC Homopolymer Dispersion Resin MW-233,000) | 1360 |
| Blacar 501 (PVC Homopolymer Blending Resin MW-95,300) | 816 |
| DOP (Di-2-ethylhexyl phthalate) | 550 |
| TXIB (2-2-4 Trimethyl-1,3 Pentanediol Monoisobutyrate ester) | 408 |
| S-160 (Butyl Benzyl phthalate | 217 |
| Synpron 744 (Ba. Zn. Phosphite Stabilizer) | 81.6 |

The release carrier is stripped from the product and can be utilized as a slip sheet when rolling up the product.

The following tables report the amounts the decorative layers are stretched and the backing layers compressed while in roll form and the change in dimensions of the surface covering on unrolling. Table I shows measurements for the decorative surface covering produced in accordance with Example 1 and Table II shows measurements for the decorative surface covering produced in accordance with Example 2. Measurements were made lengthwise on the respective surface coverings.

TABLE 1

| | | Elapsed | Wear Layer | | Backing | |
|---|---|---|---|---|---|---|
| Date | Time | Time After Unroll | 18 Inch Mark | 46 Inch Mark | 18 Inch Mark | 46 Inch Mark |
| Initial Marks | | | 17.997 | 45.996 | 18.000 | 45.999 |
| Measurement on Core. | | | 18.266 | | 17.749 | |
| Unrolled | | | | | | |
| 7-3-74 | 8:36 | 1 min. | 18.050 | 46.073 | 18.042 | 46.070 |
| | 8:40 | 5 min. | 18.038 | 46.053 | 18.032 | 46.049 |
| | 8:50 | 15 min. | 18.032 | 46.038 | 18.026 | 46.036 |
| | 9:05 | 30 min. | 18.028 | 46.030 | 18.025 | 46.033 |
| | 9:35 | 1 hr. | 18.025 | 46.020 | 18.022 | 46.024 |
| | 10:35 | 2 hr. | 18.023 | 46.020 | 18.020 | 46.021 |
| | 1:35 | 5 hr. | 18.022 | 46.017 | 18.019 | 46.019 |
| 7-8-74 | 11:35 | 123 hr. | 18.004 | 45.986 | 18.000 | 45.983 |
| 7-16-74 | 8:35 | 312 hr. | 18.001 | 45.975 | 17.998 | 45.979 |
| 7-22-74 | 8:35 | 456 hr. | 17.996 | 45.961 | 17.991 | 45.962 |

TABLE II

| | | Elapsed | Wear Layer | | Backing | |
|---|---|---|---|---|---|---|
| Date | Time | Time After Unroll | 18 Inch Mark | 46 Inch Mark | 18 Inch Mark | 46 Inch Mark |
| Initial Marks | | | 18.000 | 45.998 | 17.999 | 46.000 |
| Measurement on Core. | | | 18.219 | | 17.792 | |

TABLE II-continued

| Date | Time | Elapsed Time After Unroll | Wear Layer 18 Inch Mark | Wear Layer 46 Inch Mark | Backing 18 Inch Mark | Backing 46 Inch Mark |
|---|---|---|---|---|---|---|
| Unrolled | | | | | | |
| 7-3-74 | 8:54 | 1 min. | 18.022 | 46.041 | 18.027 | 46.048 |
| | 8:58 | 5 min. | 18.020 | 46.035 | 18.023 | 46.048 |
| | 9:08 | 15 min. | 18.017 | 46.028 | 18.020 | 46.036 |
| | 9:23 | 30 min. | 18.016 | 46.026 | 18.018 | 46.030 |
| | 9:53 | 1 hr. | 18.014 | 46.022 | 18.017 | 46.028 |
| | 10:53 | 2 hr. | 18.013 | 46.022 | 18.015 | 46.023 |
| | 1:53 | 5 hr. | 18.010 | 46.018 | 18.012 | 46.019 |
| 7-8-74 | 11:53 | 123 hr. | 18.002 | 45.994 | 18.000 | 45.990 |
| 7-16-74 | 8:53 | 312 hr. | 18.006 | 46.003 | 18.005 | 46.004 |
| 7-22-74 | 8:53 | 456 hr. | 18.001 | 46.000 | 18.000 | 45.994 |

When floors produced in accordance with Examples 1 and 2 were unrolled and installed over a wooden subfloor and before the sheets could substantially return to their original dimensions, by stapling the sheets at their peripheries to the subfloor, the sheets remained taut and flat even in a fluctuating environment.

When sheet flooring produced in accordance with Examples 1 and 2 was rolled inside out, that is with the decorative layers facing inwardly in the roll, the sheets grew on unrolling and buckled in a fluctuating environment when installed by securing the sheets at their peripheries over a wooden subfloor.

What is claimed is:

1. A method for manufacturing and installing a decorative thermoplastic surface covering which, when installed over a flat surface by securing the surface covering to the underlying surface against movement relative thereto, exhibits a self-induced tension, comprising:

(a) fusing a vinyl resin composition decorative layer and a vinyl resin composition backing layer to a strippable dimensionally stable backing to form a fused thermoplastic decorative surface covering bonded to said strippable backing;

(b) removing said strippable backing and rolling said surface covering to place said surface covering under tension and thereby elongate the layer facing outward and compress the layer facing inward while in the roll, said layers being of a composition and structure such that, on unrolling the surface covering, the elongated layer overcomes the compressed layer and the surface covering is stretched to a dimension greater than its original unrolled dimension; and (c) unrolling said surface covering whereby the stretching occurs and the surface covering is placed under tension and securing said surface covering at the periphery of said surface covering only, whereby the tendency of said elongated surface covering to return to its original dimension results in a self-induced tension which maintains said surface covering taut and thus flat.

2. The method in accordance with claim 1 wherein said outwardly facing layer is a fused decorative surface layer faced with a fused clear thermoplastic wear layer.

3. The method in accordance with claim 2 wherein the strippable backing is rolled with the decorative surface covering and acts as a slip sheet between the decorative wear layer and the backing layer in said roll.

4. A method of installing a resilient, decorative surface covering on a surface which comprises:

(a) providing in a roll an unbacked resilient, decorative surface covering which comprises a first layer of a fused thermoplastic vinyl resin-containing composition and a second layer of a fused thermoplastic vinyl resin-containing composition, said layers being joined to each other and being of a structure wherein when one layer is subjected to elongation and the other layer is subjected to compression by rolling, upon simultaneous removal of the elongative and compressive forces, the elongated layer overcomes the compressed layer and the surface covering is stretched to a dimension greater than its original unrolled dimension;

(b) unrolling said roll whereby said stretching occurs and the surface covering is placed under tension; and (c) securing the stretched surface covering to the surface to be covered at the periphery thereof only, whereby the tendency of said stretched surface covering to return to its original dimension results in a self-induced tension which maintains said surface covering taut and thus flat.

* * * * *

Disclaimer 4,159,219.—*Richard J. Evans*, Lancaster, Pa. METHOD FOR PRODUCING AN UNBACKED TENSION FLOOR. Patent dated June 26, 1979. Disclaimer filed Mar. 31, 1980, by the assignee, *Armstrong Cork Company*.

Hereby enters this disclaimer to claims 1, 2 and 4 of said patent.

[*Official Gazette, May 27, 1980.*]